US012781357B2

(12) United States Patent
Siegmund et al.

(10) Patent No.: US 12,781,357 B2
(45) Date of Patent: Nov. 3, 2026

(54) METHOD FOR THE SELECTIVE CATALYTIC HYDROGENATION OF ORGANIC COMPOUNDS, AND ELECTRODE AND ELECTROCHEMICAL CELL FOR SAID METHOD

(71) Applicants: Fraunhofer-Gesellschaft zur Förderung der angewandten Forschung e. V., Munich (DE); Ruhr-Universität Bochum, Bochum (DE)

(72) Inventors: Daniel Siegmund, Essen (DE); Ulf-Peter Apfel, Bochum (DE); Kai Junge Puring, Bottrop (DE); Kevinjeorjios Pellumbi, Essen (DE); Julian Tobias Kleinhaus, Bochum (DE)

(73) Assignees: Fraunhofer-Gesellschaft zur Förderung der angewandten Forschung e. V., Munich (DE); Ruhr-Universität Bochum, Bochum (DE)

( * ) Notice: Subject to any disclaimer, the term of this patent is extended or adjusted under 35 U.S.C. 154(b) by 0 days.

(21) Appl. No.: 18/292,825

(22) PCT Filed: Jul. 28, 2022

(86) PCT No.: PCT/EP2022/071292
§ 371 (c)(1),
(2) Date: Jan. 26, 2024

(87) PCT Pub. No.: WO2023/006930
PCT Pub. Date: Feb. 2, 2023

(65) Prior Publication Data

US 2025/0003086 A1 Jan. 2, 2025

(30) Foreign Application Priority Data

Jul. 29, 2021 (DE) ..... 10 2021 119 761.9

(51) Int. Cl.
*C25B 3/25* (2021.01)
*C25B 3/07* (2021.01)
(Continued)

(52) U.S. Cl.
CPC ..... *C25B 3/25* (2021.01); *C25B 3/07* (2021.01); *C25B 9/15* (2021.01); *C25B 9/19* (2021.01);
(Continued)

(58) Field of Classification Search
CPC ..... C25B 3/25
(Continued)

(56) References Cited

U.S. PATENT DOCUMENTS 5,919,349 A * 7/1999 Huber ..... C25B 11/04 205/423
6,733,652 B1 * 5/2004 Putter ..... C25B 3/00 205/427
(Continued)

FOREIGN PATENT DOCUMENTS

CN 113058621 A 7/2021
WO 2020/169806 A1 8/2020
WO 2020/198578 A1 10/2020

OTHER PUBLICATIONS

Holt et al., "Electrocatalytic Hydrogenation of 2-Cyclohexen-1-One in a High Sulfur Environment Using a Carbon-Supported Nanostructured Tungsten Sulfide Catalyst," Catalysis Communications (Dec. 15, 2010), vol. 12, No. 4, pp. 314-317. (Year: 2010).*
(Continued)

*Primary Examiner* — Edna Wong
(74) *Attorney, Agent, or Firm* — Volpe Koenig

(57) ABSTRACT

A process for electrocatalytic hydrogenation of organic compounds in an electrochemical cell in which the reducible organic compound is present in liquid form or at least partially in dissolved form and wherein the reducible organic compound may be hydrogenated at the cathode. The cathode comprises a transition metal chalcogenide selected
(Continued)

from sulfides, selenides and tellurides as catalyst. The application further relates to an electrode comprising a carrier material and a layer of the catalyst arranged thereupon and to an electrochemical cell comprising such an electrode and to the use of the transition metal chalcogenide catalyst for electrochemical hydrogenation of organic compounds.

10 Claims, 7 Drawing Sheets

(51) Int. Cl.

| | |
|---|---|
| ***C25B 9/15*** | (2021.01) |
| ***C25B 9/19*** | (2021.01) |
| ***C25B 11/031*** | (2021.01) |
| ***C25B 11/054*** | (2021.01) |
| ***C25B 11/075*** | (2021.01) |

(52) U.S. Cl.
CPC ..... *C25B 11/031* (2021.01); *C25B 11/054* (2021.01); *C25B 11/075* (2021.01)

(58) Field of Classification Search
USPC ..... 205/413
See application file for complete search history.

(56) References Cited

U.S. PATENT DOCUMENTS

| | | | |
|---|---|---|---|
| 2014/0110268 | A1 | 4/2014 | Jackson et al. |
| 2015/0008139 | A1 | 1/2015 | Saffron et al. |
| 2018/0222767 | A1 | 8/2018 | Ren et al. |
| 2019/0276941 | A1 | 9/2019 | Schmid et al. |

OTHER PUBLICATIONS

Zhao et al., "Sulfur Vacancy-Promoted Highly Selective Electrosynthesis of Functionalized Aminoarenes via Transfer Hydrogenation of Nitroarenes with H2O over a Co3S4—x Nanosheet Cathode," CCS Chemistry (Jan. 1, 2021), vol. 3, No. 1, pp. 507-515. (Year: 2021).*

Mehri et al., "Electrochemical Hydrogenation and Desulfurization of Thiophenic Compounds over MoS2 Electrocatalyst Using Different Membrane-Electrode Assembly," Advances in Environmental Technology (Jan. 1, 2019), vol. 5, No. 1, pp. 23-33. (Year: 2019).*

Wu et al., "Converting Copper Sulfide to Copper with Surface Sulfur for Electrocatalytic Alkyne Semi-Hydrogenation with Water," Nature Communications (Jun. 23, 2021), vol. 12, No. 1, pp. 1-11 and pp. 1-24 (Supplemental Information). (Year: 2021).*

Bezverkhyy et al., "Preparation of Highly Dispersed Pentlandites (M, M')9S8 (M, M' = Fe, Co, Ni) and their catalytic properties in hydrodesulfurization," The Journal of Physical Chemistry B (Jun. 10, 2004), vol. 108, No. 23, pp. 7709-7715. (Year: 2004).*

Strachan et al., "The Catalytic Nature of Chevrel Phases (MxMo6S8) in Review," Materials Research Bulletin (Jul. 1, 2021), vol. 139, pp. 1-8. (Year: 2021).*

Algarra et al., "Cuboidal Mo3S4 Clusters as a Platform for Exploring Catalysis: A Three-Center Sulfur Mechanism for Alkyne Semihydrogenation," ACS Catalysis (Jul. 9, 2018), vol. 8, No. 8, pp. 7346-7350. (Year: 2018).*

Piontek Stefan et al., "Bio-inspired design: bulk iron-nickel sulfide allows for efficient solvent-dependent CO 2 reduction", Chemical Science, United Kingdom, vol. 10, No. 4, Jan. 23, 2019 (Jan. 23, 2019), pp. 1075-1081, XP093021369. DOI: 10.1039/C8SC03555E. ISSN:2041-6520.

Konkena, Bharathi et al., "Pentlandite rocks as sustainable and stable efficient electrocatalysts for hydrogen generation", Nature Communications, 7: 12269, Jul. 27, 2016, (8 pages). DOI: 10.1038/ncomms12269.

* cited by examiner

METHOD FOR THE SELECTIVE CATALYTIC HYDROGENATION OF ORGANIC COMPOUNDS, AND ELECTRODE AND ELECTROCHEMICAL CELL FOR SAID METHOD

CROSS-REFERENCE TO RELATED APPLICATIONS

This application is a § 371 application of International Application No. PCT/EP2022/071292, filed Jul. 28, 2022, which claims the benefit of German Patent Application No. 10 2021 119 761.9, filed Jul. 29, 2021, which are incorporated by reference as if fully set forth.

TECHNICAL FIELD

The present application relates to a process for electrocatalytic hydrogenation of organic chemical compounds using an electrode comprising as a catalytically active layer a transition metal chalcogenide, substantially a sulfide, selenide and/or telluride. The application further relates to an electrode for electrocatalytic hydrogenation and to an electrochemical cell for performing the recited reaction. The composition of the employed catalysts may be varied and adjusted over wide ranges, so that the catalysts make it possible to establish elevated selectivity with respect to multiply-reducible compounds and different hydrogenable functional groups. The electrochemical hydrogenation according to the application may in principle be employed for any desired chemical synthesis, for example in the hydrogenation of unsaturated organic compounds. Examples include in particular the synthesis of fine chemicals, the hydrogenation of vegetable oils in fat hardening in the foodstuffs industry, the upgrading of biomass, the hydrogenolytic cleavage of relevant protecting groups and the storage of hydrogen in the form of liquid organic hydrogen carriers (LOHCs).

According to the prior art, hydrogenation of organic compounds may be performed by the following processes. Hydrogenation of organic compounds using stoichiometric hydride transfer agents, hydrogenation in thermal heterogeneously or homogeneously catalyzed processes and electrocatalytic hydrogenation reactions.

This type of hydrogenation using stoichiometric hydride transfer agents finds use especially in the reduction of C—O multiple bonds in small-scale batch processes or on a laboratory scale and requires separation of the stoichiometric waste products generated. These waste products may be subject to environmental concerns (for example cyanoboron compounds).

Thermocatalytic hydrogenations with elemental hydrogen in the presence of a suitable catalyst are associated with the inherent disadvantage of necessitating upstream hydrogen production. Furthermore, many hydrogenation reactions must be performed at elevated temperatures and pressures to ensure a sufficient conversion. This not only entails additional energy input but also makes elevated process safety demands. Often only costly transition metal complexes based on Pt, Pd, Ru, Ir or Rh may be contemplated as suitable catalysts of homogeneously catalyzed reactions. Nevertheless, selective hydrogenation of relatively complex systems, for example asymmetric hydrogenation, typically relies on thermocatalytic hydrogenations with noble metal catalysts. In heterogeneously catalyzed reactions too, noble metals are often employed. Noble metal-free catalysts are based on finely divided small particle size transition metals such as Ni. However, in contrast to the noble metals, elevated process pressures and in some cases elevated temperatures are necessary to achieve a sufficient degree of hydrogenation. A disadvantage of these systems is their severely limited selectivity in the hydrogenation of polyunsaturated compounds. In addition, the heterogeneous catalysts are often susceptible to catalyst poisons. This results in a limitation of the potentially hydrogenable substrates.

A relatively new type of hydrogenation is electrocatalysis. The electrocatalytic hydrogenation of unsaturated organic substrates through the use of electrodes based on Raney Ni on stainless steel is known (US2014110268 A). Electrocatalytic conversion with metal particles on substrates made of porous carbon has also been described (US2015008139 A). The use of (noble metal) catalysts which exhibit a low tolerance to catalyst poisons, are costly and their extraction is associated with environmental concerns, which is in turn disadvantageous. US20190276941 A1 discloses the selective hydrogenation of alkynes to alkenes at copper electrodes. Catalyst-side adaptation to difficult substrates such as electron-poor alkynes is not possible here.

In addition to the focus on noble metal-based catalysts and Raney Ni, major disadvantages of electrocatalytic processes include the limitations on flexibility (especially when two or more functional groups are present or upon hydrogenation of multiple bonds) at achievable degrees of hydrogenation and in turn susceptibility to catalyst poisons.

A noble metal-free electrocatalytic system is also known from electrocatalytic water splitting. WO 2020/169806 describes the use of pentlandites as electrocatalysts for the electrolytic production of $H_2$.

SUMMARY

It is an object of the present invention to provide a process for electrocatalytic hydrogenation of organic compounds with which the disadvantages of the prior art may be overcome. The employed electrocatalyst shall in particular have a high selectivity and adaptability to complex organic substrates, operate as energy-efficiently as possible, achieve the highest possible yields and/or ideally also be noble metal-free; it is additionally sought to realize the greatest possible current densities with the electrodes producible therefrom.

At least one of these objects is achieved by the subject matter disclosed herein, with advantageous configurations and developments described below and in the claims.

The process for electrocatalytic hydrogenation of organic compounds according to the present application has the feature that the employed electrode comprises or consists of a transition metal chalcogenide as electrocatalyst, wherein the transition metal chalcogenide is a sulfide, a selenide or a telluride (or mixtures of two or more of the recited chalcogenides such as sulfoselenides for example). The electrode (in particular the cathode) used for the catalytic hydrogenation comprises or consists of this transition metal chalcogenide as catalyst. The hydrogenation is carried out such that an organic compound to be reduced (in particular to be hydrogenated) is reduced at the cathode in an electrochemical cell (which comprises not only a cathode and an anode but also a liquid and/or solid electrolyte). The hydrogenation may be carried out either continuously (in particular in a flow cell) or discontinuously (in a batch cell).

According to the disclosure, a reducible organic compound is in particular to be understood as meaning organic compounds comprising at least one aromatic or heteroaromatic structural unit but in particular at least one multiple bond. Included here in turn are in particular C—C multiple bonds, aromatics, heterocycles, C—O multiple bonds, C—N multiple bonds, $NO_2$ groups and N—N multiple bonds or combinations of compounds having two or more of the recited groups/bonds. Both double bonds and triple bonds are contemplated; and low molecular weight substances as well as polymers are suitable. The organic compound to be reduced may be liquid and may at least partially be in dissolved form in a solvent and in both cases may also partially be in the form of a solid (provided it is ensured that at least a portion has gone into solution/is liquid); the reduction of gaseous compounds, in particular when these are at least partially in dissolved form, is also conceivable in principle. The physical state at room temperature is the benchmark here. According to the present application the electrocatalytic reduction itself is typically carried out at temperatures between −78° C. and 100° C. Since—unlike hydrogenation reactions where $H_2$ is necessarily present—the hydrogenation reactions according to the invention are typically endothermic, and according to current understanding atomic hydrogen present on the catalyst surface serves as the hydrogenating agent, there is in principle no restriction in respect of the upper limit of temperature. The specified upper limit of temperature at 100° C. is therefore based more on economic considerations. The temperature will usually be between 0° C. and 100° C. and often between 20° C. and 80° C. Furthermore and irrespective thereof, the reactions will typically be performed at standard pressure. The reduced organic compound is also typically in the abovementioned physical states, i.e. especially in the form of a dissolved substance or in the form of a liquid (the reduced compound may in principle also precipitate from the solvent as a solid which, through selection of the solvent/solvent mixture and in addition to catalyst selection, may in particular cases serve to steer the reduction towards a particular product. Irrespective of the abovementioned parameters the process according to the invention may achieve current densities of in particular at least 10 mA $cm^{-2}$ and in particular above 100 mA $cm^{-2}$. It is also possible to realize current densities up to 1 A $cm^{-2}$ especially in the case of coated electrodes and current densities of up to 2 A $cm^{-2}$ are also possible when using appropriate electrodes. However, high current densities are highly relevant from an economic standpoint (and thus in particular for industrial processes).

According to the disclosure, transition metal sulfides, selenides and tellurides employed as catalysts have the property of selectively reducing/hydrogenating organic compounds. The catalytic activity is based on the presence of the chalcogenide in particular and on the metal (cation) only to a lesser extent. It was especially found that there is a great range of variation in respect of the catalysts and their selectivity, and it is possible to influence according to the employed transition metal chalcogenide which functional group of a molecule having a plurality of reducible groups is reduced in the catalytic hydrogenation and which configurational isomers are obtained in the hydrogenation of a triple bond. It goes without saying that the chalcogenides of the invention are salt-like compounds where the chalcogen is the anion and the transition metal is the cation. A route of production for these chalcogenides typically proceeds either from mixtures of powders of the elements or from powders of the elements and from metal chalcogenides (the latter for example to establish a particular stoichiometry); in this process and alternative processes chalcogenides are typically present with a substantially uninterrupted chalcogenide structure; in other words the chalcogenides are substantially in the form of a stoichiometric chalcogenide, wherein substantially is to be understood as meaning that a certain non-stoichiometry may also be present in the context of what follows two paragraphs below. However, in exceptional cases it also possible to carry out a production process where only the surface of the catalyst particles involved in the catalytic process bears a sulfide, selenide and/or telluride layer obtained for example by reaction of the elementary metal particles with the chalcogen. The chalcogenides according to the present application thus make it possible to effect a process optimization to form a desired product. It was further found that the recited catalysts can achieve high Faraday efficiencies. In contrast to the hydrogenation processes that have long been known it is not necessary to employ a stoichiometric reduction reagent and waste products are avoided. The supply of gaseous hydrogen can likewise be eschewed; an active reduction is effected directly at the catalyst surface without the intermediate step of forming $H_2$. The protons required therefor may in particular be provided by a protic solvent or supplied to the cathodic half-cell by the anodic half-cell and the oxidation process to form protons occurring there via a membrane arranged between the half-cells and/or a solid-state electrolyte. Compared to the thermal and electrocatalytic hydrogenations according to the prior art, in particular with the noble metal catalysts palladium, platinum or ruthenium (which have hitherto been among the most active catalysts for hydrogenation reactions), the catalysts according to the present application are markedly more cost effective and sustainable, and (in electrocatalytic reactions) likewise exhibit a high activity. The systems according to the invention likewise make it possible to hydrogenate organic compounds of low purity or to perform hydrogenations of organic compounds containing sulfur. This is because the known catalyst poisons for noble metal catalysts or for other typical hydrogenation catalysts (for example $H_2S$) do not pose a problem for the catalysts employed according to the invention.

In one embodiment of the invention the transition metal chalcogenide for the electrocatalytic hydrogenation is selected from compounds substantially conforming to empirical formula MX, $MX_2$, $M_2X_3$, $M_2X_4$, $M_3X_4$, $M_9X_8$ or $M''_6M_kX_lX'_m$. M is selected from a transition metal of the 4th, 5th or 6th period wherein—for the reasons elucidated above—preference is given to the metals of the 4th period, in particular the metals of the 4th period of groups 4 to 10, and to a lesser extent also the metals of the 5th or 6th period which are not noble metals. If in doubt, preference should be given to the metals of 4th period, if only for reasons of cost. M may also be a mixture of two or more of the recited metals. The metal M will often be Fe, Co and/or Ni, or comprise at least one or more of these metals.

The metal M" is a main group metal, in particular an alkali metal or alkaline earth metal, and M" may also represent a mixture of two or more main group metals.

X represents S, Se or Te and mixtures of the recited chalcogenides, and X' represents a halide, wherein in the case of the compound class $M''_6M_kX_mX'_n$, k, m and n represent decimal numbers, wherein $24 \leq k \leq 25$, $26 \leq m \leq 28$, and $0 \leq n \leq 1$.

It will often also be the case that the sulfides and the sulfoselenides are preferred among the recited chalcogenides for reasons of toxicity alone. Without wishing to limit the generality of the foregoing and the following it appears particularly advantageous to the applicant at the present time to employ in particular transition metal chalcogenides where either the transition metal in the crystal structure can assume two different oxidation stages and/or the chalcogenide X cannot be assigned exclusively one charge in the form of $X^{2-}$, as is the case for example in the presence of $X_2^{2-}$. This applies in particular to pentlandites, chalcogenides having a spinel structure or spinel-like structure as well as, to a slightly lesser extent, to chalcogenides whose structure comprises $X_2^{2-}$ ions, for example chalcogenides having a pyrite structure or a pyrite-like structure. Such structures appear to favor the coordination of atomic hydrogen to the catalyst surface. By contrast, compounds of empirical formula MX or $MX_2$ will be selected only with lesser priority since these generally have a slightly lower stability under electrochemical conditions.

It is thus in principle the case that chalcogenides of formulae $M_2X_4$, $M_9X_8$ or $M''_6M_kX_lX'_m$ are particularly suitable, in particular when M is a metal of the 4th period of groups 4 to 10, and here in turn especially is Fe, Co and/or Ni or comprises at least one or more of these metals.

According to the invention "substantially conforming to empirical formula" is to be understood as meaning that the transition metal chalcogenides need not be pure compounds but may also be nonstoichiometric compounds or that a doping may be present. In the nonstoichiometric compounds the molar ratio X/M may be altered (upwards or downwards) for example by up to 2%, in some cases also up to 5%, or in extreme cases also up to 10% relative to the integer ratio. Dopings that may be present include in particular a doping with a nonmetal, for example with one or more of the elements B, O, N, P, As, F, Cl, Br, I, in a content of up to 5 at % based on the metal M. A doping may for example be carried out by means of the thermal production, possible for all stoichiometries, of the compounds MX, $MX_2$, $M_2X_3$, $M_2X_4$, $M_3X_4$, $M_9X_8$ or $M''_6M_kX_lX'_m$ from the elements M (wherein—as mentioned—M may also represent different transition metals) and X by admixing of the corresponding nonmetal with which doping is effected. An oxygen doping may be carried out for example by partially oxidizing the transition metal chalcogenide, for example the pentlandite. This comprises carrying out a partial surface modification with the result that a backbone of the transition metal chalcogenide X has a surface which also comprises oxygen in addition to the chalcogen X. It is also possible to carry out a doping—for example with nitrogen or a halogen—by additionally adding a chemical compound of the nonmetal with which doping is to be effected, for example a transition metal nitride or a transition metal halide, during production from the elements.

Transition metal chalcogenides, which substantially conform to the formula $M_9X_8$ and are at least partially present crystallized in the pentlandite structure (according to the present application the relevant measurement is carried out by powder x-ray diffraction), have proven particularly suitable. The compounds of formula $Fe_{9-a-b-c}Ni_aCo_bM'_cS_{8-d}Se_d$ are in turn of particular importance here. M' is selected from the same transition metals with the same preference variants as specified above for M and is especially selected from one or more metals from the group consisting of Ag, Cu, Zn, Cr and Nb, a, b, c and d are decimal numbers, but often integer or half-integer (wherein here too a stoichiometric compound and a nonstoichiometric compound as defined above may be present), wherein a is a number from 0 to 7, in particular from 1 to 6, b is a number from 0 to 9, in particular from 0 to 8, c is a number from 0 to 2, in particular from 0 to 1 and d is a number from 0 to 6, in particular from 0 to 4. The sum of a+b+c is typically a number from 0 to 9, especially from 3 to 7. It is often the case that, simultaneously, a is a number from 1 to 6, b is a number from 0 to 8, c is a number from 0 to 1, d is a number from 0 to 4 and the sum of a+b+c is a number from 3 to 7.

The proportion of the transition metal chalcogenide $M_9X_8$ present in the pentlandite structure is typically at least 80%, usually even at least 90%. Such contents are readily achievable with customary synthesis processes, in particular with the abovementioned thermal production from the elements.

In a further embodiment, the compound $Fe_{9-a-b-c}Ni_aCo_bM'_cS_{8-d}Se_d$ contains only two of the three metals or substantially only two of the three metals iron, cobalt and nickel, and no metal M' or substantially no metal M'. "Substantially" is to be understood as meaning that the proportion of the metal not present, i.e. of the metal M', based on the metal is less than 5 mol %.

In a further embodiment, the electrocatalytic reduction may be performed in both liquid electrolyte cells and solid electrolyte cells and in particular also polymer electrolyte cells. In the case of liquid electrolyte cells the organic compound to be hydrogenated is typically in aqueous/organic solution. In addition, polymer electrolyte cells also allow hydrogenation of the organic compound in pure form or as a solution. In addition the solvent may also contain a conductivity salt—for example when water or an alcohol are used as solvent; in the case of polymer electrolyte cells conductivity salts will often be eschewed. The hydrogenation may be carried out in any of the recited cells both in a discontinuous batch mode and in a continuous flow mode. The Faraday yields may additionally be optimized for the desired hydrogenation through the choice of the cell and the electrolyte. The selectivity for different hydrogenation products may additionally be influenced.

The process according to the invention may further be advantageously developed when an electrode configured as more particularly described below is employed and in particular comprises one or more of the advantageous embodiments of the electrode described below.

An electrode for electrocatalytic hydrogenation of organic compounds in an electrochemical cell comprises, in addition to an optionally present electrical contact of the electrode belonging to the electrode, a carrier material and a catalyst layer arranged at least on a portion of the surface area of the carrier material. It goes without saying that according to the present application the contact (which may be effected for example via a metal and is often attached by bonding or pressing) is thus not considered part of the carrier material. The catalyst layer contains or consists of a transition metal chalcogenide as catalyst, wherein the transition metal chalcogenide is selected from sulfides, selenides and/or tellurides.

That the catalyst layer is arranged "on" the carrier material may be understood to mean here and in the following that the catalyst layer is arranged or applied on the carrier material directly in direct mechanical and/or electrical contact. Indirect contact may also be described where further layers or regions are arranged between the catalyst layer and the carrier material.

An electrode according to the present application for the electrocatalytic process especially has one or more of the following features:

- In addition to the transition metal chalcogenide the catalyst layer comprises a polymeric binder, in particular a polymeric non-ion-conducting binder, or consists of the two components.
- In addition to the transition metal chalcogenide and an optionally present binder the catalyst layer also comprises an additive or consists of the two or (in the presence of a binder) three components.

The electrode at least partially comprises porous regions.

The electrode has a catalytically active surface area of at least 0.2 $cm^2$.

As more particularly elucidated above in respect of the process, hereby incorporated by reference in its entirety, particularly good results are typically achieved when the catalyst employed is selected from transition metal chalcogenides which substantially conform to the formula $M_9X_8$ and are at least partially present crystallized in the pentlandite structure.

In an advantageous embodiment the catalyst layer comprises a polymeric binder, in particular a polymeric binder which is not considered as belonging to the ionic polymers. This binder results in improved adhesion of the individual catalyst particles to one another and usually results in improved mechanical stability and/or also in simpler processing of the catalyst material. Depending on the carrier material it may also make it possible to realize better adhesion to the carrier material. A binder may advantageously be employed when the catalyst layer may be applied, in particular spray-applied, to the carrier material in the form of inks or when the catalyst material is employed in the form of a heat-pressable composition.

Contemplated binders especially include hydrophobic binders. These may especially be selected from polyolefins, fluorinated polyolefins, copolymers with polyolefins and/or fluorinated polyolefins, and polymer blends containing polyolefins and/or fluorinated polyolefins, wherein non-ion-conducting polymers are preferred throughout. It is optionally also possible to employ or to co-employ chlorinated polymers or copolymers (for example PVC or PVC-containing copolymers). The polyolefins and fluorinated polyolefins are especially selected from the group consisting of PE, PP, PVDF, FEP and PTFE. The proportion of the binder in the catalyst layer is typically 1% to 90% by weight, in particular 5% to 80% by weight, for example 10% to 25% by weight. At levels above 25% by weight the efficiency of the reaction often decreases in respect of the yields achieved. A sufficient adhesion of the catalyst particles to one another and on an optionally present carrier material may typically be realized above 1% by weight and in particular above 5% by weight.

In a further embodiment the catalyst layer comprises an additive in addition to the transition metal chalcogenide and an optionally present binder. The additive may especially be selected from substances for increasing electrical conductivity (for example carbon black, graphite or carbon nanotubes), substances for increasing ionic conductivity (for example ionomers such as Nafion, Sustainion, Piperion, Aemion, Durion, Orion), substances for increasing thermal conductivity, substances for increasing corrosion resistance, substances for modifying hydrophobicity and substances for improving adsorption of the organic compound to be hydrogenated (for example carbon blacks and activated carbons). It is also possible for a plurality of the recited additives to be present. Additives for improving mechanical properties and/or additives for improving adsorption properties may also be present in addition or simultaneously. Alternatively or in addition (at least) one intermediate layer may also be present between the catalyst layer and the carrier material. Conceivable here are for example layers for improving the adhesion of the catalyst layer on the carrier material or layers for improving electrical conductivity. An electrically conductive additive in the catalyst layer can also result in better distribution of the active centers. Finally, the side of the catalyst layer facing away from the carrier material may for example have a further layer applied to it for improving corrosion resistance or for altering hydrophilic/lipophilic properties of the surface.

The catalyst layer may be arranged on the carrier material in various ways. The catalyst layer may be spray-applied (in particular using an ink) but may also be applied by immersing, knife coating, printing processes, decal processes or heat pressing to form functional electrode laminates. Electrical contacting may be effected both via the front side and via the back side, i.e. the contacting may be effected either at the carrier material or at the catalyst layer itself.

The catalyst particles used for the catalyst layer may in principle have any particle size. However, particles having a d90 smaller than 10 μm determined by sieving methods have proven advantageous because larger particles are often more difficult to process, in particular when employed in inks to be spray-applied.

In a further embodiment the carrier material employed may be a porous material. Using a porous material allows the active surface area of the catalyst layer (which in the internal surface area, i.e. pores, cavities, interspaces and the like, does not form an actual layer but rather a coating) to be markedly enlarged. A surface area enlarged in this way may be obtained in particular when the porous carrier material is infiltrated with the catalyst ink, for example by immersion processes or else by spray-application. According to the present application a porous carrier material is to be understood as meaning not only a carrier material having pores (in particular having a significant proportion of macropores), wherein the porous carrier material may also have an open-pored structure, but also a carrier material in the form of a felt, in the form of a woven fabric or in the form of a braided fabric, for example a nickel mesh. Mesh-like structures are also conceivable.

Irrespective of whether the carrier material is porous it will typically be a sheetlike structure and it is especially possible to employ a carrier material which is a metal, a metal oxide, a polymer, a ceramic, a carbon-based material, a composite material or a mixture of such substances. The carrier material is generally not catalytically active itself. However, the carrier material will often exhibit electrical conductivity. The sheetlike carrier material may be in the form of a fabric, expanded mesh, felts or films for example. It may also be a membrane (in particular in the case of electrodes of a polymer electrolyte cell) or else a filter film (composed of a polymer or metal for example), for example a PTFE membrane or an Ag filter.

In a further embodiment the catalyst layer has a surface area of at least 0.2 $cm^2$, in particular at least 1 $cm^2$, preferably 1 $cm^2$ to 4 $m^2$. This may be an uninterrupted surface area but the layer/the coating may also be interrupted or divided into a plurality of mutually separate regions of the carrier material. The reported values are the external surface area and in fact only the surface area that is not facing the carrier material (this is thus substantially the side facing away from the carrier material); the internal surface area of a porous carrier material is not included in the calculation, i.e. the mathematical calculation is carried out only on the basis of the external dimensions, in the simplest case from height, length and width. According to the present application it is thus possible to produce electrodes of any desired size, wherein for a large industrial-scale application it is also possible to realize surface areas in the square meter range while for smaller amounts areas of 1 $cm^2$ or less may be advantageous.

In a further embodiment the catalyst layer of the electrode is configured such that the catalyst loading is 0.1-500 mg $cm^{-2}$, in particular 1-250 mg $cm^{-2}$, for example 2-10 mg $cm^{-2}$. The catalyst loading may be measured by weight measurement before and after application of the catalyst layer to the carrier material. A distribution of the active centers allowing significant conversion to be realized may typically be effected above surface areas of 0.5 to 1 mg $cm^{-2}$. Only a small additional effect is achieved at catalyst loadings above 250 mg $cm^{-2}$.

Also essential to the amount of active centers is the layer thickness, wherein thicker layers, however, also achieve good results upon addition of a conductivity additive. However, it is also possible to provide very thin layers (in the range of just a few nanometers, for example up to 10 nm) while thicker layers of up to 500 μm are also possible, with upper limits being very difficult to specify due to their very strong dependence on the catalyst material. Often employed for economic reasons are layer thicknesses of 5 to 50 μm (the layer thickness may be measured by scanning electron microscopy).

The object of the invention is further also achieved by an electrochemical cell for electrochemical hydrogenation which contains as an electrode, in particular as the cathode, the electrode more particularly described hereinabove. The electrochemical cell for electrocatalytic hydrogenation especially comprises a reactor containing a cathode, an anode and an electrolyte, wherein the reactor contains a reducible organic compound in liquid form or at least partially in dissolved form and wherein the reducible organic compound may be hydrogenated at the cathode. The electrode comprises a catalyst layer and a carrier layer such as are more particularly described hereinabove.

The electrochemical cell according to the present application is in particular not configured to produce a gas. The apparatus thereof is thus configured such that, while it is ensured that a gas is formed as a byproduct, the hydrogenated organic compound may be formed as the main product. This is especially to be understood as meaning that the hydrogen often formed in the electrocatalytic hydrogenation is at most 50% (based on the total current yield) provided that reasonably advantageous reaction conditions are realized. In most cases the proportion of hydrogen formed is actually less than 20%. The formation of hydrogen is ideally very largely avoided so that only values in the single-figure percent range occur.

The object of the invention is finally also achieved by the use of a transition metal chalcogenide, in particular a transition metal chalcogenide selected from compounds substantially conforming to empirical formulae MX, $MX_2$, $M_2X_3$, $M_2X_4$, $M_3X_4$, $M_9X_8$ or $M''_6M_kX_lX'_m$, for example a pentlandite, as catalyst for the electrocatalytic hydrogenation of organic compounds. The use of the compounds more particularly specified hereinabove is particularly advantageous, wherein the foregoing applies equally here too.

DETAILED DESCRIPTION

Without any intention to limit generality the invention is more particularly described below with reference to figures and working examples.

I. Electrocatalysis in Batch Mode

Figure 1:
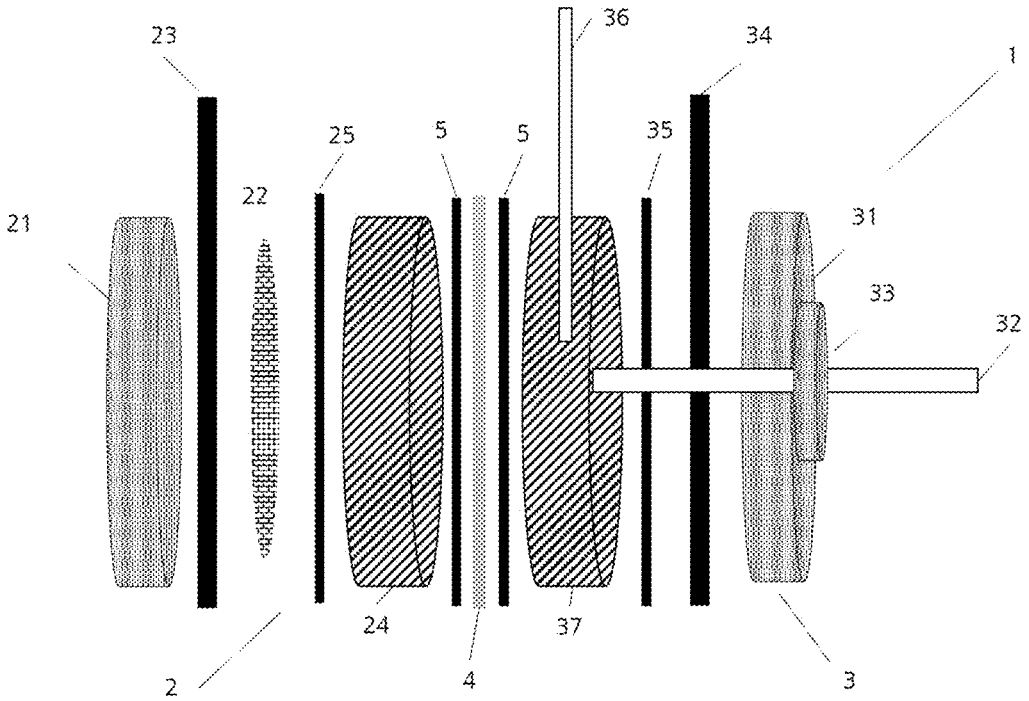
FIG. 1 shows a schematic view of an electrochemical batch cell comprising two half-cells.

The process according to the invention was initially performed with an electrochemical cell in batch mode. FIG. 1 shows a schematic view of an electrochemical batch cell 1 comprising two half-cells 2, 3. In addition to the catholyte chamber 37, the cathode half-cell 3 contains the cathode comprising the actual electrode 32, the end plate 31 and the electrode holder 33 and also reference electrode 36. In addition to the anolyte chamber 24, the anode half-cell 2 contains the anode comprising the actual electrode 22 and the end plate 21. An ion exchange membrane 4 is provided between the two chambers 2 and 3. A plurality of seals 23, 25, 5, 34, 35 are arranged therebetween.

Example 1—Electrocatalytic Hydrogenation of MBY with Pentlandite Catalysis

The cell according to FIG. 1 is used for the electrocatalytic hydrogenation of 2-methyl-3-butyn-2-ol (MBY) to afford 2-methyl-3-buten-2-ol (MBE) or 2-methyl-butan-2-ol (MBA) at room temperature. Here and hereinbelow the reaction is terminated approximately at the stage of the alkene but under appropriate reaction conditions may also be performed until substantially only the alkane is present. Pentlandite-based non-porous catalysts composed entirely of metal chalcogenide were employed as the cathode. Ni wire was used as the anode. A Nafion cation exchanger membrane was used as the membrane. A 1 M solution of MBY in a solvent/conductivity salt combination of 0.3 M KOH in methanol was employed. The cathode had a surface area of 0.071 $cm^2$ and was contacted via a brass rod in a PTFE housing. The electrocatalytic reduction was carried out for 2 hours.

For different pentlandite-based catalysts (the pentlandite catalysts were obtained by thermal synthesis from the respective elements according to B. Konkena et al., Nat. Commun. 7: 12269 doi: 10.1038/ncomms12269 (2016), wherein more than 90% by weight—measured with PXRD—were always present in the pentlandite structure) table 1 shows the Faraday efficiencies achieved based on the desired reduction to MBE in the reaction according to example 1 and the potentials (relative to a reversible hydrogen electrode $E_{RHE}$ as reference electrode) required for the hydrogenation at a current density of −100 mA $cm^{-2}$. It is apparent that Faraday efficiencies up to 100% are achievable and that lower potentials than for the use of platinum electrodes were required throughout. According to the present application the potentials were always determined using a Gamry 1010B potentiostat. According to the invention yields were always determined by NMR spectrometry using potassium hydrogenphthalate as internal standard.

TABLE 1

| Catalyst | FE-MBE/% | E/V vs. RHE |
|---|---|---|
| $Fe_{4.5}Ni_{4.5}S_7Se$ | 100 | −1.72 |
| $Fe_{4.5}Ni_{4.5}S_4Se_4$ | 59 | −1.430 |
| $Fe_{4.5}Ni_{4.5}S_3Se_5$ | 72 | −1.98 |
| $Fe_6Ni_3S_8$ | 55 | −1.78 |
| $Fe_3Ni_6S_8$ | 100 | −1.51 |
| $Fe_2Co_4Ni_3S_8$ | 69 | −1.75 |
| $Fe_4Co_2Ni_3S_8$ | 101 | −1.67 |
| $Fe_4Co_2Ni_3S_8$ | 102 | −1.50 |
| $Co_8NiS_8$ | 95 | −1.60 |
| $Co_7Ni_2S_8$ | 61 | −1.97 |

Figure 2A:
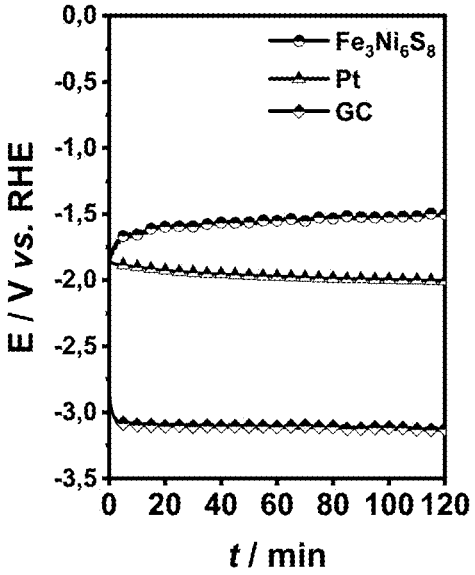
FIGS. 2A and 2B show the required potentials (E/V) for a current density of −100 mA $cm^{-2}$ and the achieved Faraday efficiencies (FE) with $Fe_3Ni_6S_8$ as catalyst compared to experiments using a platinum electrode or a glassy carbon electrode.
Figure 2B:
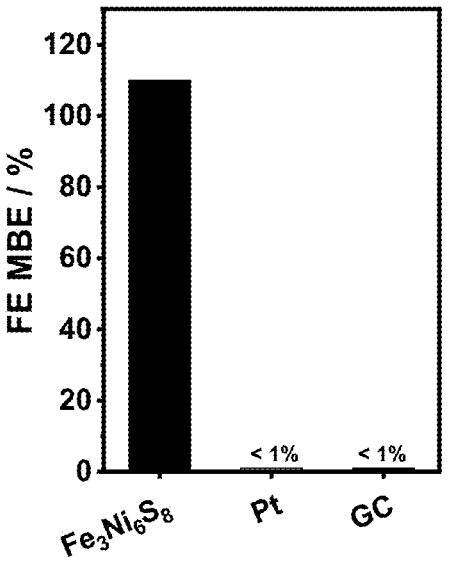

FIGS. 2A and 2B show for example 1 with $Fe_3Ni_6S_8$ as catalyst the required potentials (E/V) for a current density of −100 mA $cm^{-2}$ and the achieved Faraday efficiencies (FE) compared to experiments using a platinum electrode or a glassy carbon electrode. It is apparent that a significant efficiency is observed only in the case of $Fe_3Ni_6S_8$ as catalyst and simultaneously a lower/markedly lower potential is required than in the case of the electrodes investigated for comparison.

Example 2—Electrocatalytic Hydrogenation of Butynediol with Pentlandite Catalysis In an electrochemical cell according to example 1 the selectivity of the hydrogenation of 2-butyne-1,4-diol with two pentlandites already used in example 1 and different conductivity salt/solvent combinations was investigated (MeOH=methanol):

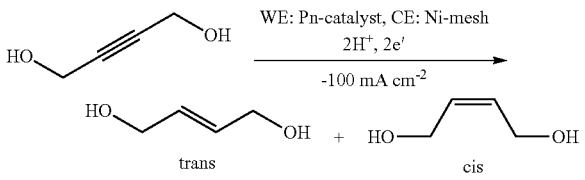

Table 2 shows that in this reaction with $Fe_3Ni_6S_8$ it is substantially the cis product that is formed while $Fe_3Co_3Ni_3S_8$ leads to elevated formation of the trans product. The use of water as the solvent and KOH as the conductivity salt shows the best selectivity and the most advantageous potential values.

TABLE 2

| Catalyst | Conditions | Faraday efficiency cis/% | Faraday efficiency trans/% | E/V vs. RHE |
|---|---|---|---|---|
| $Fe_3Ni_6S_8$ | 0.3M KOH/MeOH | 16 ± 1 | 3 | −1.38 |
| $Fe_3Ni_6S_8$ | 0.3M LiCl/MeOH | 18 | 4 ± 1 | −1.70 |
| $Fe_3Ni_6S_8$ | 0.3M KOH/$H_2O$ | 22 | <1 | −1.00 |
| $Fe_3Co_3Ni_3S_8$ | 0.3M KOH/MeOH | 5 ± 3 | 9 ± 1 | −1.33 |

Example 3—Electrocatalytic Hydrogenation of MBY Using $M''_6M_kX_mX'_n$ Catalysis The $M'_6M_kX_mX'_n$ catalysts were produced in evacuated ampoules by high-temperature synthesis. Stoichiometric amounts of the respective elements in a quartz glass ampoule were treated in a furnace at a temperature typically between 650° C. and 800° C. for 96 h. The temperature to be selected depends on the employed stoichiometry. $Ba_6Ni_{25}$: 675° C., $Ba_6Fe_{12.5}Co_{25}$: 675° C., $Ba_6Fe_{8.33}Co_{8.33}Ni_{8.33}$: 700° C. $Ba_6Fe_{12.5}Co_{25}$ subsequently heat treated for a further 96 h at 775° C. and $Ba_6Fe_{8.33}Co_{8.33}Ni_{8.33}$ for a further 96 h at 800° C. The successful synthesis of the catalysts is confirmable by PXRD analysis.

In an electrochemical cell according to example 1 the selectivity of the hydrogenation of 2-butyne-1,4-diol was investigated. In contrast to examples 1 and 2, non-porous $M''_6M_kX_mX'_n$-based catalysts composed entirely of metal chalcogenide were used as the cathode. The reaction was carried out with a 1 M MBY solution in 0.3 M KOH/$H_2O$ or 0.3 M KOH/MeOH as conductivity salt/solvent to afford butenediol.

Table 3 shows that all materials are suitable for an electrocatalytic hydrogenation.

TABLE 3

| Catalyst | Conditions | FE/% |
|---|---|---|
| $Ba_6Ni_{25}S_{27}$ | 0.3M KOH/$H_2O$ | 24.2 |
| $Ba_6Ni_{25}S_{27}$ | 0.3M KOH/MeOH | 17.6 |
| $Ba6Fe_{12.5}Co_{25}S_{27}$ | 0.3M KOH/MeOH | 19.4 |
| $Ba_6Fe_{8.33}Ni_{8.33}Co_{8.33}S_{27}$ | 0.3M KOH/MeOH | 25.1 |

Example 4—Electrocatalytic Hydrogenation of MBY with MX and $MX_2$ Catalysis

The reaction according to example 1 was carried out with transition metal sulfides of empirical formulae MS and $MS_2$ as catalyst with a 1 M MBY solution in 0.3 M KOH/$H_2O$ as conductivity salt/solvent to afford MBE. For comparison, the last row gives an example of a catalyst with pentlandite structure ($Fe_3Ni_6S_8$ from example 1). Table 4 shows the required potentials (E/V) for a current density of −100 mA $cm^{-2}$ and the achieved Faraday efficiencies (FE).

TABLE 4

| Catalyst | FE/% | E/V vs. RHE |
|---|---|---|
| NiS | 44 | −0.925 |
| FeS | 37 | −1.27 |
| $CuFeS_2$ | 78 | −1.16 |
| MnS | 18 | −1.42 |
| $Fe_3Ni_6S_8$ | 23 | −1.04 |

Example 5—Electrocatalytic Hydrogenation of Nitrocompounds, Aldehydes and Terminal Alkynes with Pentlandite Catalysis The hydrogenation according to the invention can also be used to reduce functional groups other than disubstituted alkynes. The reaction was performed under the same conditions as in example 1. In addition, table 5 specifies the employed conductivity salts, solvents, concentrations and pentlandite catalysts (also used in example 1).

TABLE 5

| Catalyst | Conditions | Reactant | Product | FE/% | E/V |
|---|---|---|---|---|---|
| $Fe_3Ni_6S_8$ | 0.3M KOH/ethanol | 0.5M nitrobenzene | Aniline | 7 | −1.27 |
| $Fe_3Ni_6S_8$ | 0.3M LiCl/ethanol | 0.5M p-anisaldehyde | p-hydroxy-methylanisole | 25 | −1.69 |
| $Fe_{4.5}Ni_{4.5}S_4Se_4$ | 0.3M KOH/methanol | 1M phenylacetylene | Styrene | 75 | −2.05 |

Example 6—Electrocatalytic Hydrogenation of MBY with Pentlandite Catalysis in a Solid Electrolyte Cell Using Different Electrode Concepts The reaction according to example 1 was also performed with other electrode concepts instead of electrodes composed entirely of metal chalcogenide, namely electrodes comprising a pentlandite coating, comprising pressed catalyst composition or comprising catalyst composition pressed onto a metal mesh.

For the coated electrode a SIGRACELL GFD 2.5 carbon felt was immersed several times in an ink composed of 90% by weight of $Fe_3Ni_6S_8$ and 10% by weight of PTFE and dried at 80° C. until the desired catalyst loading (5 mg*cm$^{-2}$) was achieved. In a departure from example 1 a 1 M MBY solution in 0.3 M KOH/$H_2O$ was employed as conductivity salt/solvent and the electrocatalytic hydrogenation performed at 80 mA cm$^{-2}$ and in a solid electrolyte cell. The produced electrodes achieved a Faraday efficiency of 25% based on MBE and 5% based on MBA at a cell voltage of 2.5 V.

For an electrode comprising a pressed catalyst composition a mixture of Kynar Superflex 2501 PVDF and $Fe_{4.5}Ni_{4.5}S_7Se$ was commixed using an IKA M20 knife mill. The composition produced was subjected to heat pressing at 170° C. and a contact pressure of 1 kN cm$^{-2}$. It is alternatively possible to employ other thermoplastics instead of PVDF. Conductive additives may optionally be added to increase the conductivity between the active centers. In a departure from example 1 a 1 M MBY solution in 0.3 M KOH/$H_2O$ was again employed as conductivity salt/solvent and the electrocatalytic hydrogenation performed in a solid electrolyte cell. Table 6 shows the required cell voltages (U/V) for a current density of 80 mA cm$^{-2}$ in the solid electrolyte cell.

TABLE 6

| Electrode composition/ % by weight | Membrane | FE-MBE/% | Cell voltage/V |
|---|---|---|---|
| 30% PVDF/70% $Fe_{4.5}Ni_{4.5}S_7Se$ | Nafion 115 | 58 | 2.5 |
| 30% PVDF/1% super P carbon/69% $Fe_{4.5}Ni_{4.5}S_7Se$ | Nafion 115 | 48 | 2.4 |
| 30% PVDF/70% $Fe_{4.5}Ni_{4.5}S_7Se$ | FM-FAA-3-PK-130 | 74 | 2.5 |

For an electrode comprising a catalyst composition pressed onto a metal mesh a mixture of Kynar Superflex 2501 PVDF and $Fe_3Co_3Ni_3S_8$ was commixed using an IKA M20 knife mill. The produced composition was pressed onto a stainless steel mesh (Haver & Boecker, 0.2 mm×0.16 mm) at 170° C. and a contact pressure of 2 kN cm$^{-2}$. The produced electrode has an elevated mechanical stability. In a departure from example 1 a 1 M MBY solution in 0.3 M KOH/$H_2O$ was again employed as conductivity salt/solvent and the electrocatalytic hydrogenation performed in a solid electrolyte cell. Table 7 shows the required cell voltages (U/V) for a current density of 80 mA cm$^{-2}$ in a solid electrolyte cell.

TABLE 7

| Electrode composition/% by weight | FE-MBE | Cell voltage/V |
|---|---|---|
| 30% PVDF/70% $Fe_3Co_3Ni_3S_8$ | 21 | 2.2 |

II. Electrocatalysis with a Flow Cell

Figure 3:
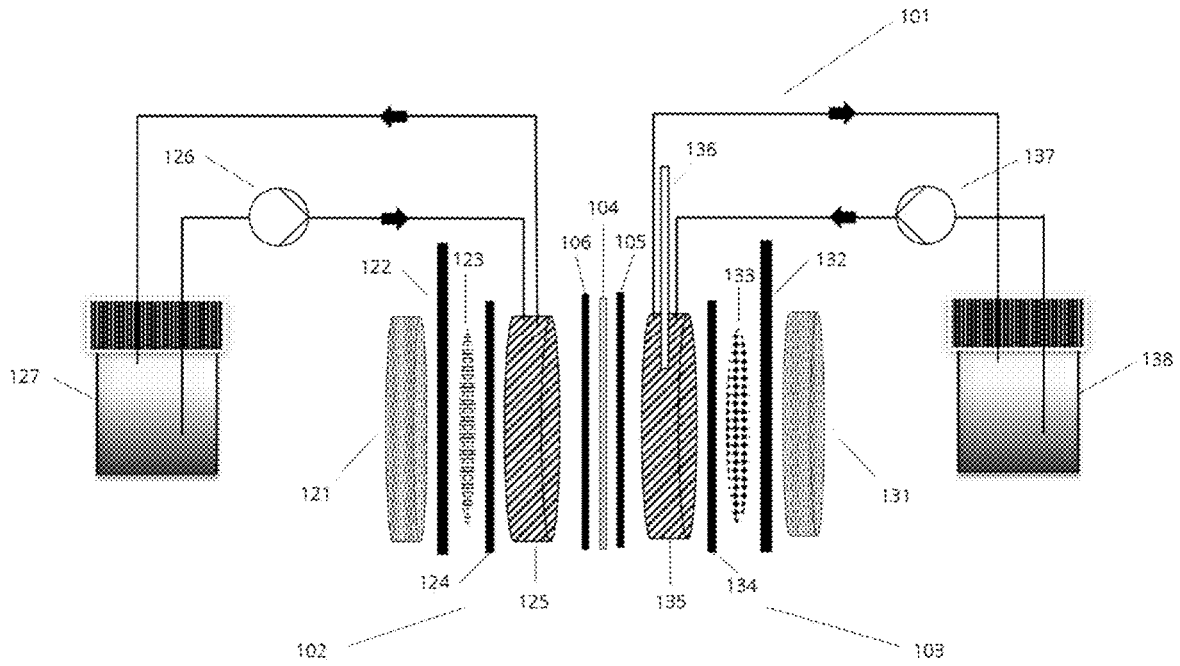
FIG. 3 shows a schematic view of an electrochemical flow cell comprising two half-cells.

The process according to the invention was initially performed with an electrochemical cell in batch mode. FIG. 3 shows a schematic view of an electrochemical flow cell 101 comprising two half-cells 102, 103. In addition to the catholyte chamber 135, the cathode half-cell 103 contains the cathode comprising the actual electrode 133 and the end plate 131 and also the reference electrode 136. The catholyte chamber 135 is supplied with catholyte from the reservoir 138 via a pump 137. In addition to the anolyte chamber 125, the anode half-cell 102 contains the anode comprising the actual electrode 123 and the end plate 121. The anolyte chamber 125 is supplied with anolyte from the reservoir 127 via a pump 126. An ion exchange membrane 104 (in the following examples an FS-10120-PK cation exchange membrane was used for example) is provided between the two chambers 102, 103. A plurality of seals 122, 124, 132, 134 and the membrane-retaining seals 105, 106 are arranged therebetween.

The transition metal chalcogenide-containing electrodes were produced by spray-application of a mixture of the transition metal chalcogenide with a binder, for example PTFE, onto a porous carbon-containing carrier material, for example onto a carbon fiber fabric, or by application thereof onto the carrier material in the form of a heat-pressable composition. Spray-application may be effected for example using 15 ml of an ink composed of 5% by weight of PTFE and 85% by weight of $Fe_3$ $Ni_6S_8$ on a 10 cm×10 cm W1S1010 CeTech Carbon Cloth to obtain a catalyst loading of 2 mg cm$^{-2}$. Heat pressing is carried out using a mixture of ground PTFE powder with the transition metal chalcogenide catalyst and a 10 cm×10 cm carbon substrate which has an active area of 9 cm×7 cm.

This makes it much easier to create larger electrode surface areas. Compared to the cells described at I, these higher surface area electrodes also make it possible to realize markedly higher current densities, for example current densities of up to 1 A $cm^{-2}$.

Example 7—Electrocatalytic Hydrogenation of MBY with Pentlandite-Coated Electrodes with Different Binders and Current Densities In a flow cell according to FIG. 3 a 1 M solution of MBY in 0.3 M KOH in $H_2O$ is hydrogenated at room temperature using an electrode with a catalyst loading of the pentlandite $Fe_3Ni_6S_8$ (production as in example 1) of 2 mg $cm^{-2}$. The electrolyte chamber has a volume of 15 ml and the flow rate is 8 ml $min^{-1}$. The electrocatalytic reduction was carried out for 2 hours. The cathode was produced by spray-application of the catalyst onto the carrier material using an ink, wherein the size of the electrode as described above with a one-sided coating obtained by spray application is 7.1 $cm^{-2}$. The ink contains (A) 258 μL of a 60% by weight PTFE dispersion as a binder, 15 g of a 1% by weight methyl cellulose (MC) solution in water as an inert additive, 5 g of water as solvent and 1 g of the catalyst or (B) 258 μL of a 60% by weight PTFE dispersion as binder and 15 g isopropanol (IPA) and 5 g of water as solvent and 1 g of the catalyst.

Figure 4A:
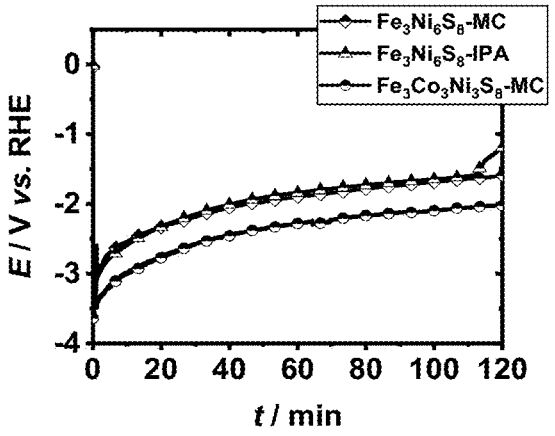
FIGS. 4A and 4B show the required potentials (E/V) for a current density of −100 mA $cm^{-2}$ and the achieved Faraday efficiencies (FE), yields, and selectivity comparing $Fe_3Ni_6S_8$ as catalyst with the use of MC-based ink, $Fe_3Ni_6S_8$ as catalyst with the use of IPA-based ink and $Fe_3Co_3Ni_3S_8$ as catalyst with the use of MC-based ink.
Figure 4B:
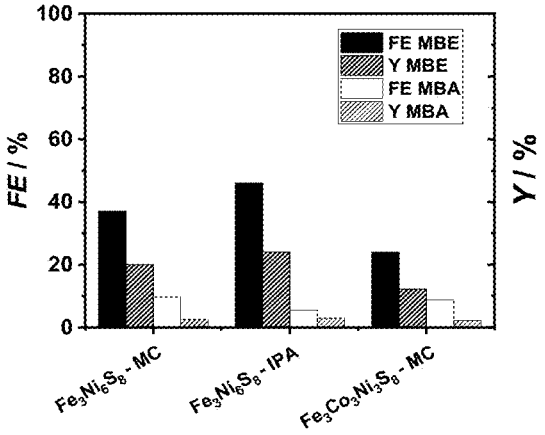

FIG. 4A shows for a current density of −100 mA $cm^{-2}$ that the composition of the ink has only a small effect on the required potential. However, FIG. 4B shows that the use of IPA inks results in somewhat better yields (Y) and Faraday efficiencies (FE) and a somewhat better selectivity with respect to stopping the reduction at the alkane (MBE) while forming only relatively little alkane (MBA). The slightly better yields for the IPA ink are likely due to better exposed active centers.

Figure 5A:
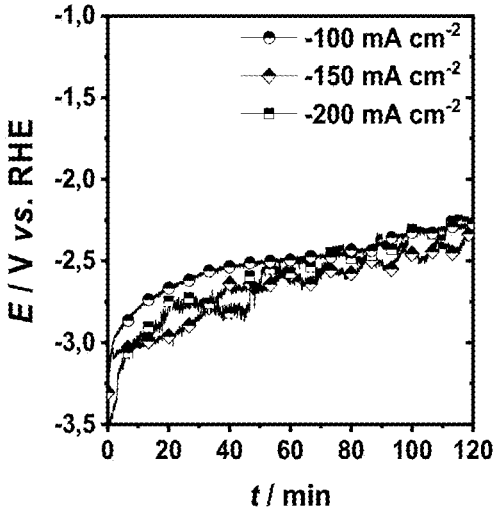
FIGS. 5A and 5B show the effect of the current density on the required potential (E/V), and on the yield (Y) and Faraday efficiency (FE) for the IPA-based ink.
Figure 5B:
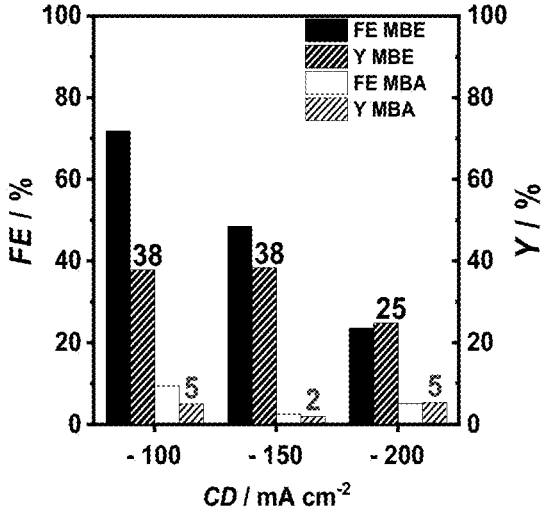

FIGS. 5A and 5B show for the IPA-based ink the effect of the current density on the required potential (E/V) and on the yield (Y) and Faraday efficiency (FE). It is apparent (FIG. 5A) that the current density has no significant effect on the required potential. While Faraday efficiency decreases at higher current densities (CD); yield and selectivity (MBE/MBA) remain fairly constant (FIG. 5B).

Example 8—Electrocatalytic Hydrogenation of MBY with Pentlandite-Coated Electrodes with Different Binder Contents The procedure of example 8 corresponds to that of example 7/IPA ink with the exception that the employed ink contains a varying content of the binder PTFE. Experiments were carried out with 10%, 15% and 25% by weight of PTFE based on the total weight of the catalyst layer.

Figure 6A:
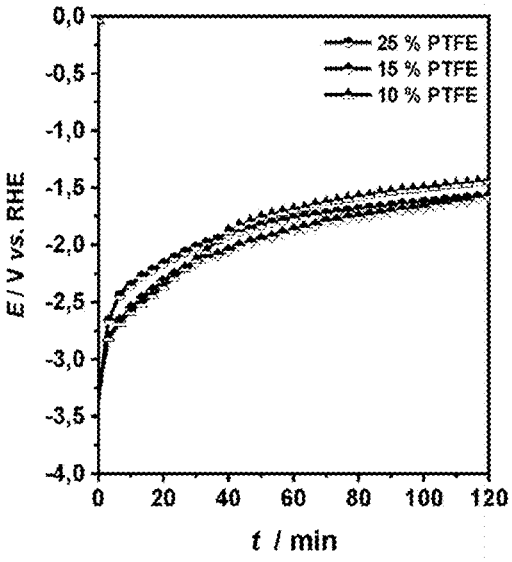
FIGS. 6A and 6B show the effect of binder content on the required potential (E/V) and on the yield (Y) and Faraday efficiency (FE) with the use of IPA-based ink and a varying content of the binder PTFE.
Figure 6B:
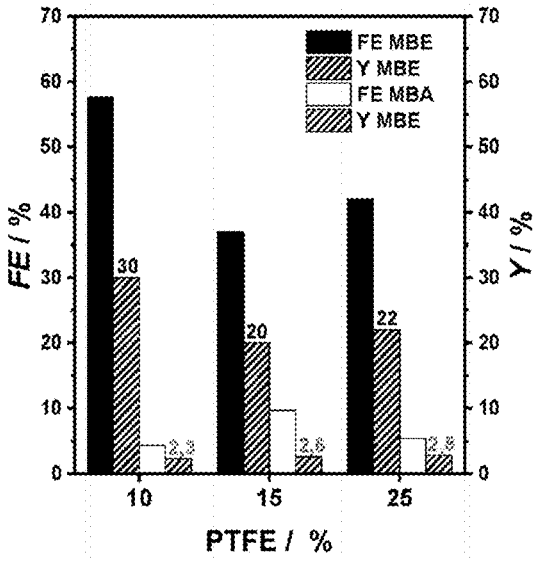

FIGS. 6A and 6B show the effect of the binder content on the required potential (E/V) and on the yield (Y) and Faraday efficiency (FE). It is apparent (FIG. 6A) that an elevated binder content has only a very small effect on the required potential. However, Faraday efficiency and yield decrease slightly; selectivity (MBE/MBA) remains reasonably constant. It may be deduced therefrom that while a markedly elevated binder proportion has a positive effect on mechanical stability, excessive binder contents usually result in lower yields.

Example 9—Electrocatalytic Hydrogenation of MBY with Pentlandite-Coated Electrodes with Different Catalyst Loadings The procedure of example 9 corresponds to that of example 7/IPA ink having a PTFE content of 10% by weight with the difference that more ink was spray-applied onto the carrier material. The spraying process was performed until a loading of 0.6, 1, 2 or 5 mg $cm^{-2}$ was able to be detected.

Figure 7A:
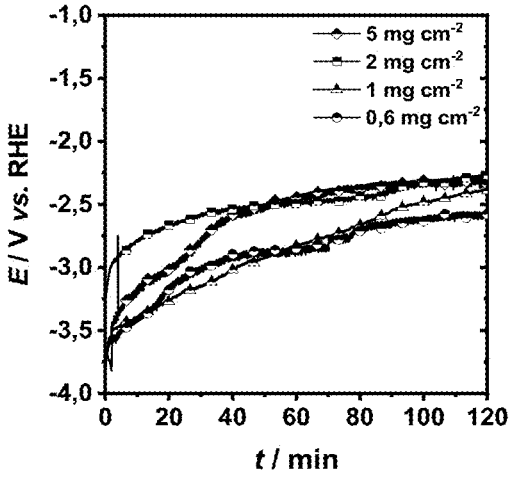
FIGS. 7A and 7B show the effect of catalyst loading (CL) on the required potential (E/V), and on the yield (Y) and Faraday efficiency (FE) with IPA-based ink sprayed with varying loading.
Figure 7B:
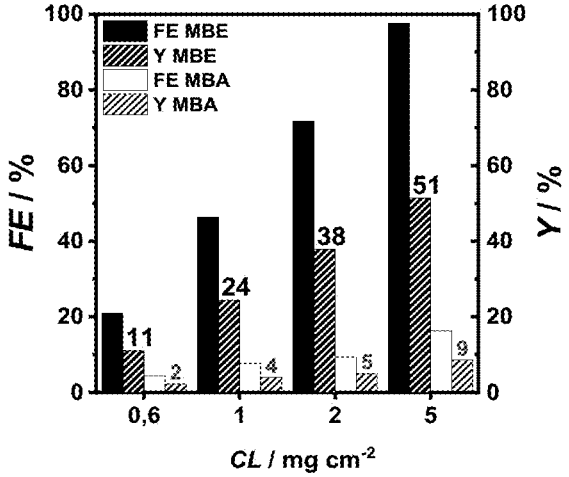

FIGS. 7A and 7B show the effect of catalyst loading (CL) on the required potential (E/V) and on the yield (Y) and Faraday efficiency (FE). It is apparent FIG. 7A) that very low catalyst loadings result in a worsening in respect of the potential to be applied. However an increase in loading above a value of 1 mg $cm^{-2}$ does not result in significant changes. It has only a very small effect on the required potential. However, higher loadings result in greater yields; selectivity (MBE/MBA) remains reasonably constant.

Example 10—Electrocatalytic Hydrogenation of MBY with Pentlandite-Coated Electrodes with Different Catalysts and Different Membranes In contrast to example 7, the polymer electrolyte membranes of the flow cell were varied. Employed on the one hand was a proton exchange membrane (PEM) (Fumatech BWT GmbH (FS-10120-PK)); and on the other hand an anion exchange membrane (AEM) (Fumatech BWT GmbH (FM-FAA-3-PK-130)). Different catalysts were also employed in contrast to example 7. The inks used for this purpose correspond to those of example 7/IPA-based but wherein 15% by weight of PTFE were employed as binder. The catalyst loading was in each case 2 mg $cm^{-2}$.

Figure 8A:
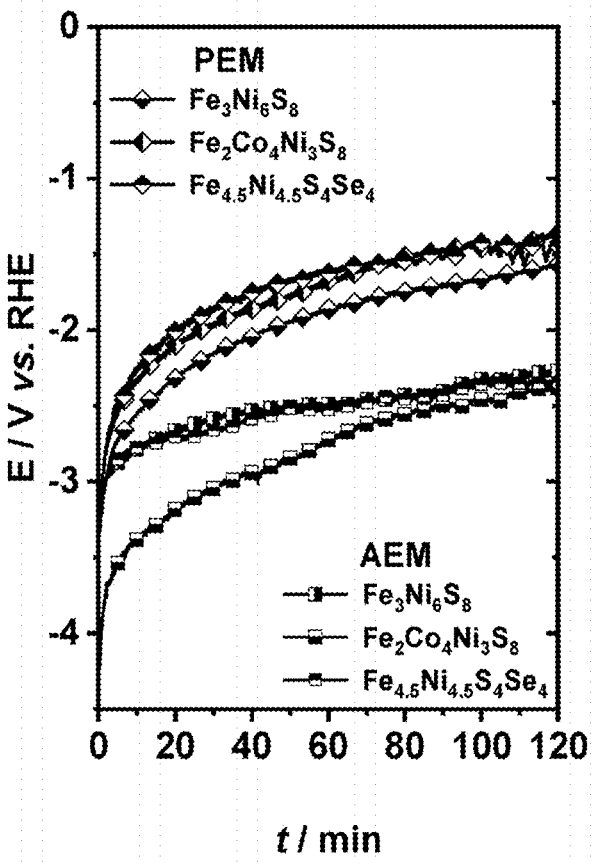
FIGS. 8A and 8B show the effect of proton exchange membrane (PEM) versus anion exchange membrane (AEM) on the required potential (E/V), and on the yield (Y) and Faraday efficiency (FE), and selectivity comparing $Fe_3Ni_6S_8$ as catalyst, $Fe_{4.5}Ni_{4.5}S_4Se_4$ as catalyst and $Fe_2Co_4Ni_3S_8$ as catalyst, with the use of IPA-based ink.
Figure 8B:
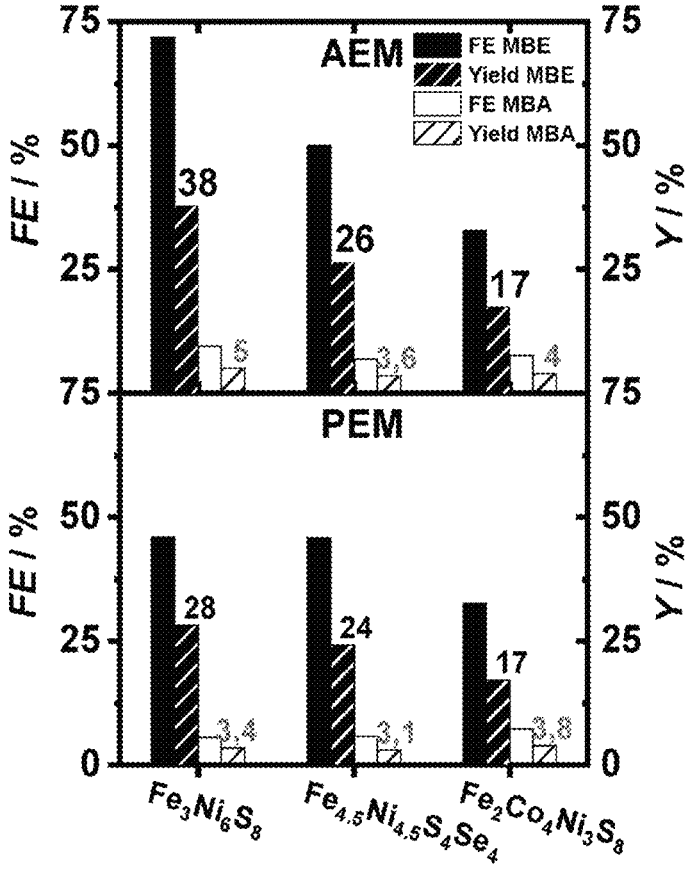

FIGS. 8A and 8B show the effect of the membrane (PEM or AEM) on the required potential (E/V) and on the yield (Y) and Faraday efficiency (FE). It is apparent (FIG. 8A) that the proton exchange membranes consistently lead to better results in respect of the required potential. However, when the employed catalyst is also taken into account different catalysts/membrane combinations that are particularly advantageous become apparent. In terms of potential the selenium-containing catalyst $Fe_{4.5}Ni_{4.5}S_4Se_4$ is best for PEM and about equal with $Fe_2Co_4Ni_3S_8$; by contrast for AEM $Fe_2Co_4Ni_3S_8$ is slightly poorer than the other two catalysts. A different picture emerges for yields and Faraday efficiencies. Here, $Fe_3Ni_6S_8$ provides the best results for both membranes, wherein these are markedly better for the anion exchange membrane than for the proton exchange membrane. However, $Fe_{4.5}Ni_{4.5}S_4Se_4$ shows slightly poorer selectivity in respect of the MBE/MBA ratio. In summary it must be noted that, while the proton exchange membranes are slightly more energy efficient since the required potential is lower, they also provide lower yields.

Example 11—Electrocatalytic Hydrogenation of MBY with Pentlandite-Coated Electrodes at Different Temperatures In contrast to example 7 the hydrogenation reactions were performed at different temperatures.

Figure 9A:
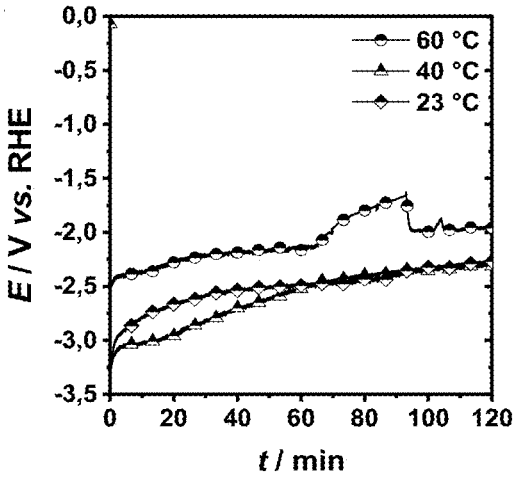
FIGS. 9A and 9B show the effect of temperature on the required potential (E/V), and on the yield (Y) and Faraday efficiency (FE), and selectivity.
Figure 9B:
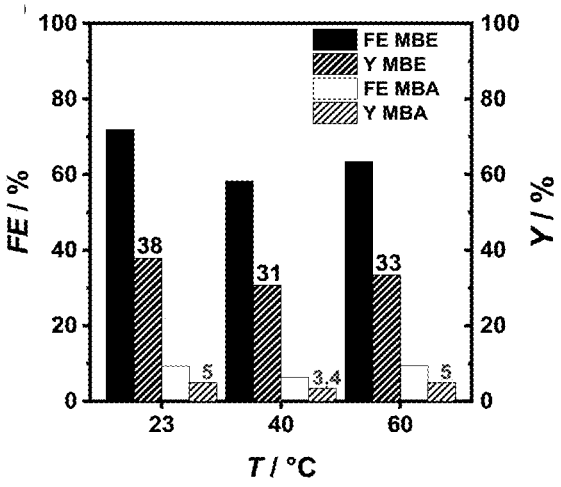

FIGS. 9A and 9B show the required potential (E/V) and the yield (Y) and Faraday efficiency (FE) for various reaction temperatures. While higher temperatures result in a slightly lower required potential, yield and Faraday efficiency are slightly higher at room temperature. A significant effect on selectivity is not observable.

Figure 10:
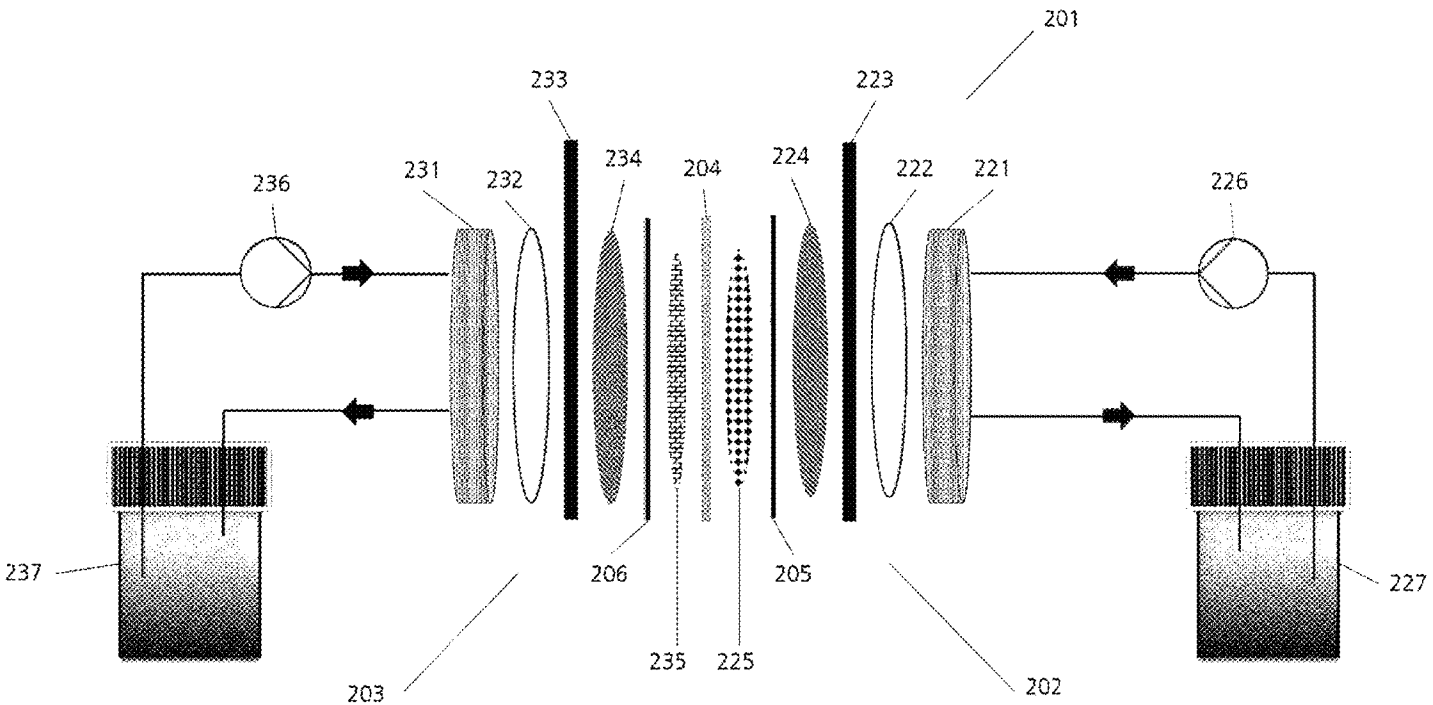
FIG. 10 shows a schematic view of a solid electrochemical cell comprising two half-cells.

Example 12—Electrocatalytic Hydrogenation of MBY with Pentlandite-Coated Electrodes in a Solid Electrolyte Cell FIG. 10 shows a schematic view of a solid electrolyte cell 201 comprising two half-cells 202, 203. In addition to the cathode flow field 234, the cathode half-cell 203 contains the cathode comprising the actual electrode 235, the collector plate 233, and the end plate 231, as well as the plastic spacer 232. The cathode flow field 234 is supplied with catholyte from the reservoir 237 via a pump 236. In addition to the anode flow field 224, the anode half-cell 202 contains the anode comprising the actual electrode 225, the collector plate 223, and the end plate 221, as well as the plastic spacer 222. The anode flow field 224 is supplied with anolyte from the reservoir 227 via a pump 226. An ion exchange membrane 204 is provided between the two chambers 202 and 203. A plurality of seals 205, 206 are arranged therebetween.

In contrast to example 7 a polymer electrolyte system was used instead of a liquid electrolyte system. Instead of the FS-10120-PK cation exchange membrane an FM-FAA-3-PK-130 anion exchange membrane was used. Furthermore, as in example 7, the IPA ink was employed but with a PTFE content of 10% by weight. The current density was not −100 but only −80 mA $cm^{-2}$. A Faraday efficiency of 67% (for MBE) was achieved at a cell voltage of −2.5 V.

Example 13-Electrocatalytic Hydrogenation of MBY in a Solid Electrolyte Cell with Pentlandite Electrodes at Different Current Densities The reaction according to example 12 ($Fe_3Ni_6S_8$-coated electrodes) was initially repeated at different currents with 1 M MBY in 0.3 M KOH/$H_2O$. Table 8 shows that while at constant reaction times (2 hours) and higher current densities the Faraday efficiency decreases, the yield increases. Further increases in selectivity and conversion for the target hydrogenation products at higher current densities are achievable by adapting the employed electrolyte.

TABLE 8

| Current density/ mA $cm^{-2}$ | FE-MBE/% | Conversion MBE/% | FE-MBA/% | Conversion MBA/% | Cell voltage/V |
|---|---|---|---|---|---|
| 40 | 62.4 | 23.3 | 9.1 | 1.7 | 2.4 |
| 80 | 71.8 | 56.9 | 7.9 | 3.1 | 2.3 |
| 160 | 44.4 | 66.3 | 12 | 8.6 | 2.7 |
| 240 | 30.2 | 67.7 | 8.2 | 9.1 | 2.9 |

Example 14—Electrocatalytic Hydrogenation of MBY in a Solid Electrolyte Cell with Pentlandite Electrodes with Different Binders For the reaction according to example 12 the binders of the pentlandite coating were also varied. Different ion exchange membranes were also used: the Piperion A80 (Versogen) and FM-FAA-3-PK-130 (Fumatech) anion exchange membranes and the Nafion 115 (IonPower) cation exchange membrane. Binders employed included both fluorine-containing polymers and the ionomers Piperion (Versogen), Aemion (Ionomr) and Nafion (IonPower). The abovementioned ionomers not only have the function of a binder but also the function of a conductivity-increasing additive.

The electrodes examined were produced on W1S1010 Carbon Cloth (CeTech) using an IPA ink at a binder loading of 10% by weight and a catalyst loading of 2.5 mg $cm^{-2}$. The reaction according to example 10 is performed at 80 mA $cm^{-2}$ with the recited membranes and the coated electrodes.

Table 9 shows the effect of different binders on the hydrogenation reaction.

TABLE 9

| Binder | Membrane | FE-MBE/% | FE-MBA/% |
|---|---|---|---|
| Nafion | Nafion 115 | 23.2 | 2.2 |
| PVDF | Nafion 115 | 9.1 | 2.3 |
| Aemion | Nafion 115 | 12.4 | 4.1 |
| PTFE | Nafion 115 | 20.8 | 6.5 |
| Piperion | Piperion A80 | 9.1 | 2.3 |
| PTFE | Piperion A80 | 12.4 | 7.4 |
| PTFE | FM-FAA-3-PK-130 | 22.4 | 8.5 |
| Aemion | FM-FAA-3-PK-130 | 24.7 | 1.8 |

The Faraday efficiency for the hydrogenation changes according to the employed combination. Hydrophobic binders such as the recited fluorine-containing polymers generally show a higher Faraday efficiency for the electrochemical hydrogenation (as is demonstrable with PTFE, Nafion and PVDF).

Example 15—Electrocatalytic Hydrogenation of MBY in a Solid Electrolyte Cell with Different Catalysts (Comparative Example)

For comparison with the present application the reaction according to example 12 was also performed with electrocatalysts of the prior art. For comparison, Pd-based electrodes (current industrial state-of-the-art) were generated with Pd particles (Alfa Aesar, 0.35-0.8 μm) analogously to example 12. Furthermore, Ni foam (1.6 mm, Goodfellow) was employed directly as electrode material.

Table 10 shows the effect of the electrocatalyst on the hydrogenation of MBY. The reaction was performed according to example 12 again with a 1 M MBY solution in 0.3 M KOH/$H_2O$ as conductivity salt/solvent at 80 mA $cm^{-2}$. The $Fe_3Ni_6S_8$ catalyst shows slightly better Faraday efficiencies and cell voltages than the industrial Pd standard. Compared to the Ni foam the $Fe_3Ni_6S_8$ shows a markedly higher activity and selectivity for the hydrogenation.

TABLE 10

| Catalyst | FE-MBE/% | FE-MBA/% | Cell voltage/V |
|---|---|---|---|
| $Fe_3Ni_6S_8$ | 71.8 | 7.9 | 2.3 |
| Pd | 63.6 | 28.2 | 2.1 |
| Ni foam | 10.2 | 4.1 | 2.6 |

Example 16—Electrocatalytic Hydrogenation of Aromatic Alkynes and Aldehydes with Pentlandite Catalysis To produce the electrode the IPA ink having a PTFE content of 10% by weight was spray-applied to a carbon felt (Sigracell GFD 2.5). An $Fe_3Ni_6S_8$ coating was applied with a loading of 5 mg $cm^{-2}$. Analogously to example 7 the reaction of a 1 M phenylacetylene solution in 0.3 M KOH/MeOH as conductivity salt/solvent was performed at a current density of 80 mA $cm^{-2}$. A cation exchange membrane (Nafion 115) was employed in the solid electrolyte cell. The hydrogenation achieved a Faraday efficiency of 30% (for phenylethylene) at a cell voltage of 2.2 V.

The same electrode under the same conditions was used to perform the hydrogenation of a 1 M benzaldehyde solution in 0.3 M sodium acetate/MeOH as conductivity salt/solvent. A Faraday efficiency of 10% (for benzyl alcohol) was achieved at a cell voltage of 4.0 V.

The invention claimed is:

1. A process for electrocatalytic hydrogenation of organic compounds in an electrochemical cell having a cathode, an anode, and an electrolyte, wherein the organic compounds are reducible organic compounds comprising at least one multiple bond, the process comprising:

hydrogenating a multiple bond of the reducible organic compounds at the cathode, wherein the reducible organic compounds are in liquid form or at least partially in dissolved form, the cathode comprises a catalyst in the form of a transition metal chalcogenide, said catalyst arranged as a catalyst layer on at least a portion of a surface area of a carrier material of the cathode and said catalyst layer comprises the transition metal chalcogenide and a polymeric binder, and the transition metal chalcogenide conforms to the empirical formula $M_3X_4$, $M_9X_8$ or $M''_6M_kX_mX'_n$, wherein M represents one or more metals selected from the transition metals of the 4th, 5th or 6th period, $M_3X_4$ has a spinel structure, M" is selected from alkali and alkaline earth metals, X represents S, Se and Te, X' represents a halide, and k, m and n represent decimal numbers, wherein $24 \leq k \leq 25$, $26 \leq m \leq 28$ and $0 \leq n \leq 1$.

2. The process as claimed in claim 1, wherein the transition metal chalcogenide conforms to the empirical formula $M_9X_8$ or $M''_6M_kX_mX'_n$ and M is selected from a transition metal of the 4th period of groups 4 to 10.

3. The process as claimed in claim 2, wherein the transition metal chalcogenide conforms to formula $M_9X_8$ and is at least partially present in crystallized form in a pentlandite structure.

4. The process as claimed in claim 3, wherein the transition metal chalcogenide conforming to formula $M_9X_8$ is a compound of formula $Fe_{9-a-b-c}Ni_aCO_bM'_cS_{8-d}Se_d$, wherein M' is a transition metal of the 4th period, a is a number from 0 to 7, b is a number from 0 to 9, c is a number from 0 to 2, d is a number from 0 to 6, and the sum of a+b+c is a number from 0 to 9.

5. The process as claimed in claim 4, wherein the transition metal chalcogenide contains substantially only two of the three elements Fe, Ni and Co and also substantially no metal M'.

6. The process as claimed in claim 1, wherein the at least one multiple bond comprises at least one C—C multiple bond.

7. The process as claimed in claim 1, wherein the polymeric binder is selected from at least one of polyolefins, fluorinated polyolefins, copolymers with polyolefins and/or fluorinated polyolefins, and polymer blends containing polyolefins and/or fluorinated polyolefins.

8. The process as claimed in claim 1, wherein the proportion of the polymeric binder in the catalyst layer is 1% to 90% by weight.

9. The process as claimed in claim 1, wherein the catalyst layer has a catalyst loading of 0.1-500 mg $cm^{-2}$.

10. The process as claimed in claim 1, wherein the catalyst layer has an external surface area of at least 0.2 $cm^2$.

* * * * *